US011931634B2

(12) United States Patent
Krishna Vajjala

(10) Patent No.: US 11,931,634 B2
(45) Date of Patent: Mar. 19, 2024

(54) MAGNETICALLY ALIGNED HINGED GOLF TEES

(71) Applicant: Arun Krishna Vajjala, Aldie, VA (US)

(72) Inventor: Arun Krishna Vajjala, Aldie, VA (US)

(73) Assignee: Arun Krishna Vajjala, Aldie, VA (US)

( * ) Notice: Subject to any disclaimer, the term of this patent is extended or adjusted under 35 U.S.C. 154(b) by 2 days.

(21) Appl. No.: 17/729,799

(22) Filed: Apr. 26, 2022

(65) Prior Publication Data

US 2023/0338797 A1 Oct. 26, 2023

(51) Int. Cl.
*A63B 57/10* (2015.01)

(52) U.S. Cl.
CPC ..... *A63B 57/10* (2015.10); *A63B 2209/08* (2013.01)

(58) Field of Classification Search
CPC ..... A63B 2209/08
See application file for complete search history.

(56) References Cited

U.S. PATENT DOCUMENTS 1,623,119 A * 4/1927 Kearney ..... A63B 57/13 473/391
1,717,962 A * 6/1929 Deike ..... A63B 57/12 473/401
1,807,377 A * 5/1931 De Witt ..... A63B 57/12 473/397
2,146,736 A * 2/1939 Hammond ..... A63B 57/10 473/401
2,839,304 A * 6/1958 Lerick ..... A63B 57/12 473/396
3,406,978 A * 10/1968 Johnson, Jr. ..... A63B 57/10 473/397
3,966,214 A * 6/1976 Collins ..... A63B 57/19 473/397
4,418,916 A * 12/1983 Matsuura ..... A63B 57/12 473/396
4,645,208 A * 2/1987 Morabeto ..... A63B 57/10 473/396
6,899,644 B1 * 5/2005 Song ..... A63B 57/13 473/397
8,439,771 B1 * 5/2013 Fleming ..... A63B 57/13 473/397
D700,260 S * 2/2014 Geiger ..... D21/718
8,936,521 B2 * 1/2015 Lee ..... A63B 57/10 473/396
9,216,338 B1 * 12/2015 Lee ..... A63B 57/13
(Continued)

FOREIGN PATENT DOCUMENTS

GB 2415635 A * 1/2006 ..... A63B 57/10
GB 2608655 A * 1/2023 ..... A63B 57/10
(Continued)

*Primary Examiner* — Steven B Wong
(74) *Attorney, Agent, or Firm* — Hauptman Ham, LLP

(57) ABSTRACT

A golf tee may comprise an upper portion, a lower portion, a hinge, and a magnetic coupler. The hinge may be coupled to the upper portion and the lower portion and enables rotation between the upper portion and the lower portion only about a single axis. The magnetic coupler may be coupled to the upper portion and the lower portion and releasably maintains axial alignment between the upper portion and the lower portion by magnetic force.

17 Claims, 2 Drawing Sheets

(56) References Cited

U.S. PATENT DOCUMENTS

| | | | | |
|---|---|---|---|---|
| 2005/0261089 | A1* | 11/2005 | Homby | A63B 57/10<br>473/387 |
| 2007/0270246 | A1* | 11/2007 | Salmon | A63B 57/10<br>473/397 |
| 2012/0064985 | A1* | 3/2012 | Kumar | A63B 57/15<br>473/257 |
| 2013/0331206 | A1* | 12/2013 | Kumar | A63B 57/10<br>473/396 |

FOREIGN PATENT DOCUMENTS

| | | | | | |
|---|---|---|---|---|---|
| KR | 20120114661 | A | * | 10/2012 | |
| KR | 20130086472 | A | * | 8/2013 | |
| WO | WO-2005021109 | A1 | * | 3/2005 | A63B 57/10 |
| WO | WO-2006004308 | A1 | * | 1/2006 | A63B 57/10 |

* cited by examiner

MAGNETICALLY ALIGNED HINGED GOLF TEES

BRIEF DESCRIPTION OF THE DRAWINGS

The following detailed description of specific embodiments of the present disclosure can be best understood when read in conjunction with the following drawings, where like structures are indicated with like reference numerals and in which.

DETAILED DESCRIPTION

One or more embodiments include a golf tee hinged at the middle and which remains axially aligned using magnetic force. It is contemplated that the golf tee would be inserted into the ground, vertically aligned so that an axis of rotation of an upper portion of the tee is perpendicular to an anticipated shot direction, remaining vertically aligned using magnetic force, and then the upper portion of the tee is rotated when struck by a golf club.

Figure 1:
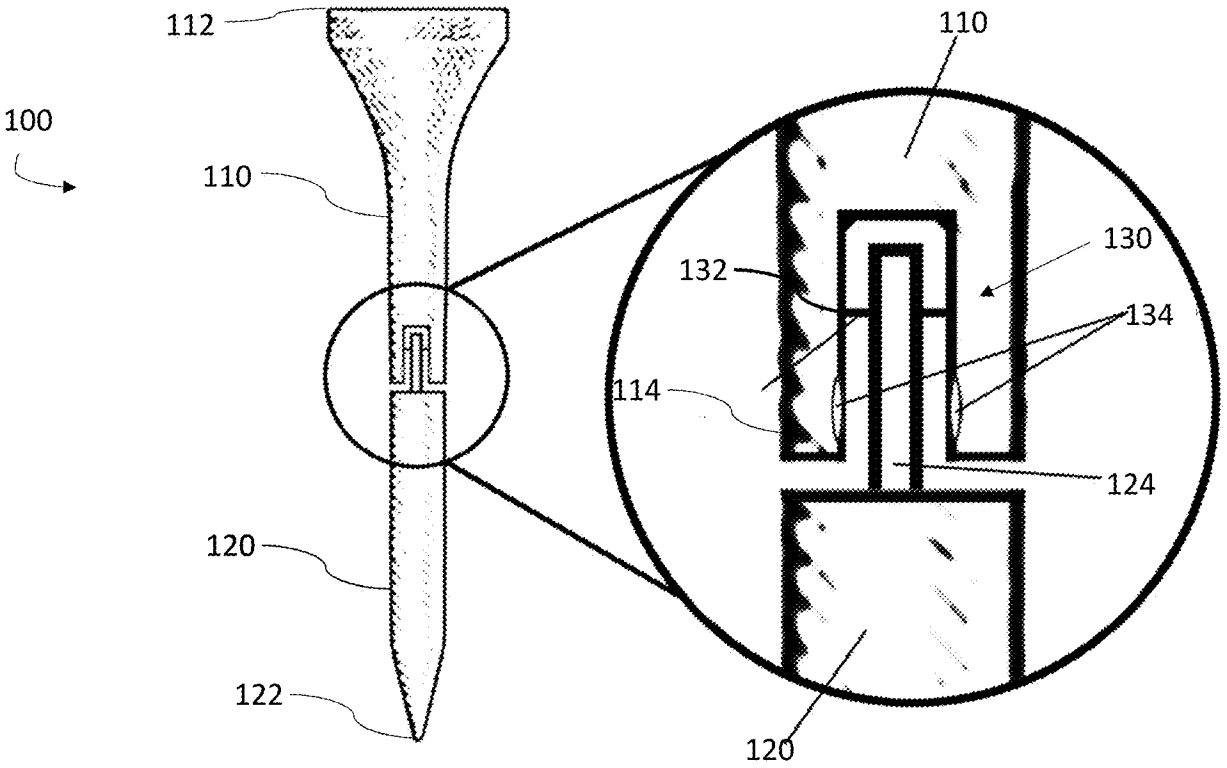
FIG. 1 is a side view with an inset close-up view of an embodiment of the present disclosure.

Referring to FIG. 1, a golf tee 100 may comprise an upper portion 110, a lower portion 120, and a hinge 130. The hinge 130 may couple the upper portion 110 with the lower portion 120.

Figure 2:
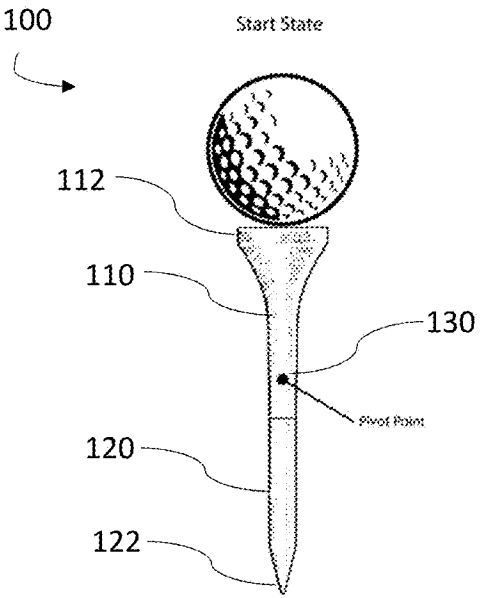
FIGS. 2 through 4 are a sequence of side views of an embodiment of the present disclosure in use.

As best seen in FIG. 2, the upper portion 110 may support a golf ball thereon. For example, the upper portion 110 may have a ball support 112. In some embodiments, the ball support 112 has a recessed or concave cross-section for accommodating the curvature of the ball placed thereon. In some embodiments, the upper portion 110 lacks ball support 112.

Returning to FIG. 1, the lower portion 120 may be designed to be inserted into the ground. The lower portion 120 may comprise a straight shaft and a pointed end 122. In some embodiments, the lower portion 120 comprises a curvilinear or non-straight shaft.

The upper portion 110 and the lower portion 120 may each comprise a material suitable for fashioning a golf tee. For example, the upper portion 110 and the lower portion 120 of the golf tee may comprise wood, plastic, ceramic, composites, nonferrous metals, ferrous metals or the like. In some embodiments, the upper portion 110 and the lower portion 120 may comprise the same material. In other embodiments, the upper portion 110 and the lower portion 120 may comprise different materials.

The hinge 130 may enable rotation between the upper portion 110 and the lower portion 120 only about a single axis. The hinge 130 may include a pin 132 extending perpendicular to the long axis of the golf tee 100. The upper portion 110 comprises a pair of fingers 114 protruding from the bottom of the upper portion. The fingers 114 may extend about one-sixth of the length of the upper portion 110. Alternatively, the length of the fingers 114 may extend between one percent and 50 percent of the upper portion 110. The pin 132 may extend between the pair of fingers 114. Accordingly, the upper portion 110 may rotate about the pin 132. Specifically, the upper portion 110 may only rotate about the pin 132.

A magnetic coupler may couple the upper portion 110 with the lower portion 120. The magnetic coupler may include one or more components, such as a ferromagnetic portion 124 and one or more magnets 134. The magnetic coupler may include a plurality of magnets, where the magnets are arranged such that opposing charges align the upper portion 110 and the lower portion 120. The components of the magnetic coupler may be provided in both the upper portion 110 and the lower portion 120. The magnets 134 may be attached to the fingers 114. For example, the magnets 134 may be glued or screwed onto fingers 114. Alternatively, the magnets 134 may be attached to the bottom of the fingers 114 and magnetically engage a ferrous plate at the top of the bottom portion 120, or vice versa.

The magnetic coupler may also include a ferromagnetic portion 124 extending from a center of the lower portion 120 distal from the pointed end 122. Specifically, the magnetic coupler may include the ferromagnetic portion 124 at the radial center of the lower portion 120. The hinge pin 132 may pass through the ferromagnetic portion 124. In some embodiments, the ferromagnetic portion 124 extends through the entire length of the lower portion 120. In some other embodiments, the ferromagnetic portion 124 extends through only part of the length of the lower portion 124.

The magnetic coupler may include the ferromagnetic portion 124 coupled to at least one of the upper portion 110 or the lower portion 120. In some embodiments, the ferromagnetic portion 124 is directly coupled to the upper portion 110 and the plurality of magnets are directly coupled to the lower portion 120. In alternate embodiments, the ferromagnetic portion 124 is directly coupled to the lower portion 120 and the plurality of magnets are directly coupled to the upper portion 110.

The magnetic coupler 130 may include at least one magnet 134 coupled to the upper portion 110 and a ferromagnetic portion 124 coupled to the lower portion 120. The magnet 134 may be configured to magnetically engage with the ferromagnetic portion 124 when the upper portion 110 and the lower portion 120 are axially aligned. Alternatively, the magnetic coupler may include at least one magnet 134 coupled to the lower portion 120 and a ferromagnetic portion 124 coupled to the upper portion 110. The magnet 134 may magnetically engage with the ferromagnetic portion 124 when the upper portion 110 and the lower portion 120 are axially aligned. Thus, the magnetic coupler may retain the upper portion 110 and the lower portion 120 in axial alignment.

The magnetic coupler may be configured to releasably maintain axial alignment between the upper portion 110 and the lower portion 120 by magnetic force. The magnetic coupler may provide sufficient magnetic force to keep the golf tee axially aligned despite being subjected to force such as wind or the weight of the ball resting on upper portion 110. However, the magnetic coupler may provide a low enough amount of magnetic force such that the magnetic coupler will fail to maintain axial alignment of the upper portion 110 and the lower portion 120 when the golf tee is struck by a golf club. Specifically, the alignment force may be less than the breaking strength of the materials used in the construction of the upper portion 110 and the lower portion 120.

According to some embodiments, a method of using a golf tee 100 may comprise inserting a golf tee into the ground and aligning the axis of rotation of the hinge 130 of the golf tee 100 perpendicular to a desired direction of a shot. By aligning the axis of rotation of the hinge 130 perpendicular to the shot direction, the top 110 of the golf tee 100 may rotate as shown in FIG. 2.

Figure 3:
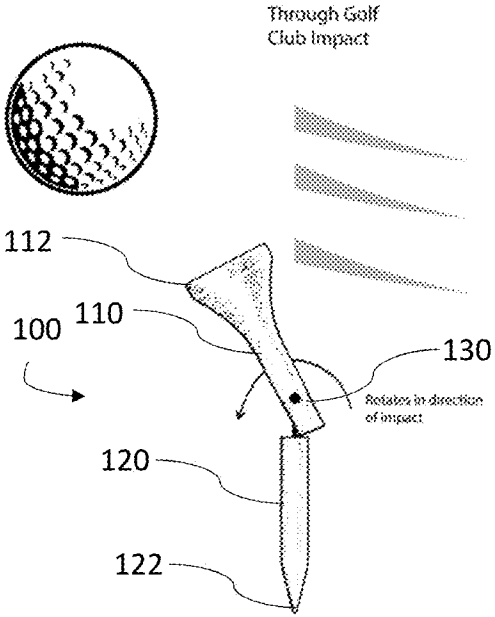
Figure 4:
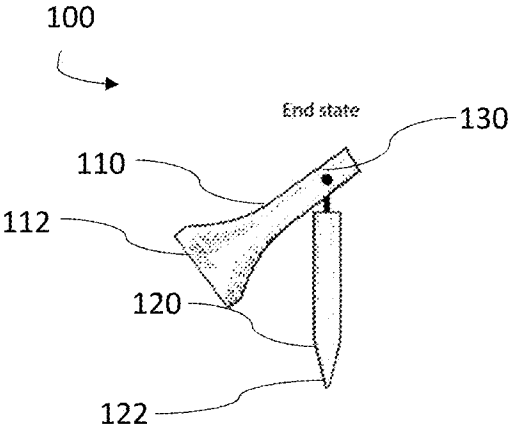

As is illustrated in FIGS. 2 through 4, the method of using a golf tee 200 may comprise striking the golf tee with a golf club and breaking the alignment of the upper portion 110 and the lower portion 120 of the golf tee 100. FIG. 2 shows the tee 100 aligned in an initial position. FIG. 3 shows tee 100 after it has been struck, with upper portion 110 being rotated with respect to lower portion 120. FIG. 4 shows the upper portion 110 being realigned with the lower portion 120 of the golf tee 100 as shown in FIG. 2.

I claim:

1. A golf tee comprising;

an upper portion, wherein the upper portion includes a plurality of fingers;

a lower portion;

a hinge coupled to the upper portion and the lower portion and enabling rotation between the upper portion and the lower portion only about a single axis; and a magnetic coupler coupled to the upper portion and the lower portion and configured to releasably maintain axial alignment between the upper portion and the lower portion by magnetic force, where the magnetic coupler includes a ferromagnetic portion at a center of the lower portion and extends into the lower portion towards the distal end.

2. The golf tee of claim 1, wherein the magnetic coupler includes at least one magnet coupled to the upper portion, the at least one magnet being configured to engage with the ferromagnetic portion in response to the upper portion and the lower portion being axially aligned.

3. The golf tee of claim 2, wherein the at least one magnet includes two or more magnets.

4. The golf tee of claim 1, wherein the hinge includes a pin, and the upper portion rotates only about the pin.

5. The golf tee of claim 4 wherein the pin extends between the fingers and the magnetic coupler includes a portion disposed on the plurality of fingers.

6. The golf tee of claim 1, further comprising:

the upper portion comprises a first surface, the lower portion comprises a second surface, wherein the first surface and second surface are substantially mated when the magnetic coupler maintains axial alignment, and wherein the upper portion is capable of rotation to a position where the first surface is not mated to the second surface.

7. The golf tee of claim 6, wherein the hinge includes a pin, and the upper portion rotates only about the pin.

8. A golf tee comprising;

an upper portion, wherein the upper portion includes a plurality of fingers;

a lower portion;

a hinge coupled to the upper portion and the lower portion and enabling rotation between the upper portion and the lower portion only about a single axis; and a magnetic coupler coupled to the upper portion and the lower portion and configured to releasably maintain axial alignment between the upper portion and the lower portion by magnetic force, wherein the magnetic coupler includes a ferromagnetic portion at the geometric center of a cross section of the lower portion.

9. The golf tee of claim 8, wherein the magnetic coupler includes at least one magnet coupled to the upper portion, the at least one magnet being configured to engage with the ferromagnetic portion in response to the upper portion and the lower portion being axially aligned.

10. The golf tee of claim 9, wherein the at least one magnet includes two or more magnets.

11. The golf tee of claim 8, wherein the hinge includes a pin, and the upper portion rotates only about the pin.

12. The golf tee of claim 11 wherein the pin extends between the fingers and the magnetic coupler includes a portion disposed on the plurality of fingers.

13. A golf tee comprising;

an upper portion, wherein the upper portion includes a plurality of fingers;

a lower portion;

a hinge coupled to the upper portion and the lower portion and enabling rotation between the upper portion and the lower portion only about a single axis; and a magnetic coupler coupled to the upper portion and the lower portion and configured to releasably maintain axial alignment between the upper portion and the lower portion by magnetic force, wherein the magnetic coupler includes a ferromagnetic portion at the linear center of the lower portion taken along the full length of the lower portion.

14. The golf tee of claim 13, wherein the magnetic coupler includes at least one magnet coupled to the upper portion, the at least one magnet being configured to engage with the ferromagnetic portion in response to the upper portion and the lower portion being axially aligned.

15. The golf tee of claim 14, wherein the at least one magnet includes two or more magnets.

16. The golf tee of claim 13, wherein the hinge includes a pin, and the upper portion rotates only about the pin.

17. The golf tee of claim 16 wherein the pin extends between the fingers and the magnetic coupler includes a portion disposed on the plurality of fingers.

* * * * *